United States Patent [19]

Clements

[11] Patent Number: 5,066,306

[45] Date of Patent: Nov. 19, 1991

[54] PROCESS FOR REMOVING PERMANGANATE STAINS FROM ARTICLES

[75] Inventor: James L. Clements, Henderson, Ky.

[73] Assignee: 501 P.B. & S. Chemical Company, Inc., Henderson, Ky.

[21] Appl. No.: 564,750

[22] Filed: Jul. 31, 1990

Related U.S. Application Data

[63] Continuation-in-part of Ser. No. 387,899, Aug. 1, 1989, Pat. No. 4,961,749.

[51] Int. Cl.[5] ..... D06L 3/06

[52] U.S. Cl. ..... 8/109; 8/101; 8/110; 8/111

[58] Field of Search ..... 8/108, 101, 109, 111; 162/65

[56] References Cited

U.S. PATENT DOCUMENTS

| | | | |
|---|---|---|---|
| 1,768,819 | 7/1930 | Bradley et al. | 8/111 |
| 2,052,320 | 8/1936 | Sjostrom | 127/71 |
| 2,172,233 | 9/1939 | Wilson | 149/5 |
| 3,384,444 | 5/1968 | Simpson et al. | 8/111 |
| 3,589,922 | 6/1971 | Asdell et al. | 106/288 B |
| 3,732,171 | 5/1973 | Kuhajek et al. | 252/105 |
| 4,795,476 | 1/1989 | Bean et al. | 8/107 |

*Primary Examiner*—Prince E. Willis
*Assistant Examiner*—John F. McNally
*Attorney, Agent, or Firm*—Donald L. Cox

[57] ABSTRACT

A process for bleaching articles, such as fabrics, comprising the steps of treating an article with a permanganate bleaching agent and then reducing the permanganate with a reducing composition comprised of ammonium bisulfite and ammonium sulfite.

40 Claims, No Drawings

PROCESS FOR REMOVING PERMANGANATE STAINS FROM ARTICLES

CROSS REFERENCE TO RELATED APPLICATIONS

This application is a continuation-in-part of Ser. No. 07/387,899 filed Aug. 1, 1989, now U.S. Pat. No. 4,961,749.

BACKGROUND OF INVENTION

1. Field of Invention.

This invention relates to bleaching. More particularly, this invention relates to bleaching articles, such as fabrics and garments, employing a permanganate and a reducing composition comprised of ammonium bisulfite and ammonium sulfite.

2. Prior Art.

In the past few years, the wearing of "stone washed" materials has become popular. Stone washing new clothes, such as denim jeans, imparts a soft, worn look to them. Usually, pumice stones having diameters of about one-half to about four inches are used in a washing machine to circulate with the garments during the wash cycle thereby causing the garments to abrade and to soften. Although some prior art processees of stone washing are designed to prepare garments and fabrics having a uniform faded color, other prior art processees are designed to produce garments having streaks and non-uniform colors.

One method of preparing fabrics with non-uniform colors is to saturate pumice stones with a bleaching agent, wash the garments in the presence of the pumice stones, and then reduce the bleaching agent. This process is disclosed in U.S. Pat. No. 4,795,476. The patent discloses that garments are first treated with a permanganate bleaching agent and then the permanganate is reduced with a reducing mixture comprising a metabisulfite and a sulfite. The patent claims that the use of sodium sulfite with sodium metabisulfite reduces the odor of sulfur dioxide during washing at temperatures between 100° to 140° F. The patent, however, does not disclose that ammonium bisulfite can be used as the main reducing agent or that a reducing composition comprising ammonium bisulfite and ammonium sulfite simplifies the process while reducing sulfur dioxide odor.

U.S. Pat. No. 3,732,171 discloses a composition for removing iron ions from iron stained substances. The composition comprises a combination of an alkali metal hydrosulfite, such as sodium hydrosulfite, and an alkali metal sulfite contributor, such as sodium sulfite and ammonium sulfite. The patent discloses that the evolution of sulfur dioxide is significantly reduced when sodium sulfite or ammonium sulfite is used in conjunction with sodium hydrosulfite. However, the patent does not disclose that when ammonium sulfite is used in conjunction with ammonium bisulfite, the evolution of sulfur dioxide odor is significantly reduced.

U.S. Pat. Nos. 2,052,320, 2,172,233, 3,384,444 and 3,589,922 and British Patent No. 586,020 disclose the use of potassium permanganate as a bleaching agent and the reduction of the permanganate with a sulfite. However, these patents do not disclose the reduction of the permanganate with a reducing composition comprising ammonium bisulfite and ammonium sulfite and do not suggest that such a reducing composition would reduce the odor of sulfur dioxide.

U.S. Pat. No. 1,768,819 discloses a process for bleaching fibers and fabrics with a manganate or permanganate. In order to remove the brown color left by the manganate or permanganate, the fibers or fabrics are treated with sulfur dioxide, a bisulfite, or a sulfite and an acid. The patent, however, does not disclose that ammonia can be employed with sulfur dioxide or that a mixture of ammonium sulfite and ammonium bisulfite should be employed. The patent also makes no attempt to reduce the sulfur dioxide odor and in fact teaches the use of straight sulfur dioxide.

One of the problems with permanganate bleaching processees is that during the reduction of the permanganate with sulfites, there is usually a strong sulfur dioxide odor which is undesirable. Another problem in the prior art processes is that expensive sulfite reducing agents, such as sodium metabisulfite and sodium sulfite, are employed. A further problem is that most of the sulfite reducing agents have a limited solubility in water thereby adding to the cost of reducing permanganates.

Accordingly, it is an object of the invention to reduce the generation of sulfur dioxide in a permanganate bleaching process.

It is a further object of this invention to decrease the costs of reducing permanganate bleaching agents in a permanganate bleaching process.

These and other objects are obtained by the process of the present invention.

SUMMARY OF INVENTION

The instant invention constitutes a bleaching process comprising the step of:

(a) treating an article to be bleached with a permanganate bleaching agent; and (b) reducing the permanganate with a reducing composition containing a weight percent ratio of sulfur dioxide to ammonia in the range of about 1.80:1 to about 3.80:1 so that during the bleaching process substantially no sulfur dioxide odor is detectable.

The process of the present invention can be employed to bleach a wide variety of articles, including wood pulp, fibers, fabrics, and garments.

DETAILED DESCRIPTION OF INVENTION

In the instant invention a wide variety of permanganate bleaching agents may be employed, such as alkali metal and alkaline-earth metal permanganates. Preferably, potassium permanganate and sodium permanganate are employed, and most preferably potassium permanganate is employed as the permanganate bleaching agent. The permanganate alone may be used or the permanganate compounded with other materials may be employed. For example, the permanganates can be compounded with calcium sulfate and diatomaceous earth. One such suitable compounded material is Denox 300 which is prepared by the Carus Chemical Co. These special permanganate compounds are readily available commercially. In addition, other oxidizing agents, such as sodium hypochlorite, may be employed with the permanganate bleaching agents.

The process of this invention can be used to bleach a wide variety of articles that have been treated with or stained by a permanganate bleaching agent. For example, the process can be used to reduce permanganate stained wood pulp, fibers, fabrics, and garments. Preferably, the process is used to reduce permanganate stained fibers, fabrics and garments, and most preferably is used to reduce permanganate stained fabrics and garments, such as jeans.

A wide variety of methods may be employed to treat an article with the permanganate bleaching agent. One method involves preparing a permanganate solution which is applied to an article or in which an article is placed. For example, the article can be submerged in a vat containing the permanganate solution. Generally, the permanganate will be dissolved in water. The amount of permanganate employed will depend upon the degree of bleaching and the nature of the material employed. Generally, a solution containing about 1 to about 8 percent by weight permanganate based upon the total weight of permanganate and water will be employed. The permanganate bleaching process is generally conducted at a temperature of about 60° F. to about 110° F.

When fabrics or garments are to be bleached and a non-uniform color is desired, pumice stones or similar substances saturated with the permanganate bleaching agent may be used. Generally, a wide variety of hard, course materials having some porosity can be used, such as coral stone, chopped up brick or concrete, or diatomaceous earth. Such materials may be placed in conventional washers and agitated with the fabrics or garments. Although the time of agitation will depend upon the degree of bleaching desired, usually, the garments and fabrics are agitated for about 8 to about 35 minutes at a wash temperature of about 60° F. to about 110° F. The bleaching effect is dependent on the permanganate concentration and the characteristics of the stone or similar substance used to treat the fabric. When garments and fabrics are treated, any suitable agitation means may be employed, such as a conventional washer.

After the article is treated with the permanganate bleaching agent, the article will have brown stains from the permanganate. In order to remove these brown stains, it is necessary to reduce the permanganate stain. According to the instant invention the permanganate stain can be reduced by a reducing composition comprising ammonium bisulfite and ammonium sulfite in water. Although the reducing composition will be comprised primarily of ammonium bisulfite, ammonium bisulfite is not employed alone since an undesirable level of sulfur dioxide odor is present when temperatures above 50° F. are employed. In order to permit the reducing process to take place at temperatures above 50° F. without the presence of a strong sulfur dioxide odor, it is necessary to employ ammonium sulfite in conjunction with ammonium bisulfite. Preferably, the reduction of permanganate takes place at a temperature in the range of about 60° F. to about 180° F., most preferably in the range of about 100° F. to about 150° F.

The pH of the reducing composition must be such that when the permanganate stains are reduced, there is virtually no sulfur dioxide odor. The proper pH to accomplish this will depend upon the temperature at which the reduction takes place and the acidity or alkalinity of the article being treated. Generally, the lower the temperature, the lower the pH should be, the more acidic the article being treated, the higher the pH should be, and, the more alkaline the article, the lower the pH should be.

In most circumstances, after the article is treated with a permanganate bleaching agent, such as potassium permanganate or sodium permanganate, the article will be neutral (or only slightly basic). The appropriate pH of the reducing composition for such neutral articles will be in the range of about 4.5 to about 6.5, preferably about 5.0 to about 6.0, and most preferably about 5.5 to about 5.6. With neutral articles, if the pH exceeds about 6.5, the reducing composition does not function well and it takes longer periods of time to reduce the permanganate stains. In addition, when neutral articles are treated, if the pH falls below about 4.5, an odor problem with sulfur dioxide will develop.

There are occasions when the article might be acidic or alkaline. The article might be acidic because prior to being treated with the permanganate bleaching agent, the article might be treated with an acid in an effort to accelerate the rate of oxidation by the permanganate bleaching agent. For example, the article might be soaked in a 3 to 10 percent by weight solution of acetic acid in water prior to being bleached. The article might be alkaline because some of the commercially available powdered permanganate compounds which may be employed as bleaching agents contain sodium tetraborate, which renders the article alkaline.

If the acidic or alkaline article is neutralized prior to being treated with the reducing composition, then it is not necessary to adjust the pHs given above for the reducing composition. However, if the article is not neutralized, it is necessary to adjust the pH ranges given above so that the article will be neutralized and the permanganate stains reduced without an odor problem with sulfur dioxide. Generally, when the article is alkaline or contains alkaline compounds, the reducing composition should have a pH in the range of about 1.5 to about 4.5. If the article is alkaline and the reducing composition has a pH lower than about 1.5, an odor problem with sulfur dioxide is likely to develop. When the article is acidic, the reducing composition should have a pH in the range of about 6.5 to about 8.5. If the article is acidic and the reducing composition has a pH above about 8.5, the reducing composition will tend to not function well and it will take longer periods of time to reduce the permanganate stains. Thus, the overall range of the pH to be employed with any type of article will be in the range of about 1.5 to about 8.5.

All of the pHs described above refer to the initial pH of the reducing composition. After the article is added to the reducing composition, the pH either rises or falls, depending upon the acidity or alkalinity of the article. The actual pH while the permanganate stains are being reduced is preferably in the range of about 3.5 to about 4.5. When the pH is in that range, reduction of the stains takes place rapidly and efficiently. In other words, the initial pH should be selected so that the pH during the actual reduction of the permanganate stains will preferably be in the range of about 3.5 to about 4.5.

In order to prepare a reducing composition which contains the appropriate amount of ammonium bisulfite and ammonium sulfite so as to substantially eliminate the odor of sulfur dioxide at the temperature at which the reduction of permanganate stains takes place, sulfur dioxide and ammonia are mixed with water at a certain weight percent ratio. The weight percent ratio will depend upon the acidity or alkalinity of the article being treated. When the article is alkaline or contains an alkaline compound, the ratio of sulfur dioxide to ammonia will be higher than when the article is neutral or acidic.

Since the articles are usually neutral (or only slightly basic) after treatment with the permanganate bleaching agent, the percent by weight ratio of sulfur dioxide to ammonia will usually be in the range of about 3.1:1 to about 3.65:1, preferably about 3.3:1 to about 3.5:1, and most preferably about 3.5:1. If the permanganate stained article is neutral, and the ratio of 3.65:1 of sulfur dioxide to ammonia is exceeded, then there will be an odor problem with sulfur dioxide.

When the permanganate stained article is alkaline, the reducing composition should have a weight percent ratio of sulfur dioxide to ammonia in the range of about 3.65:1 to about 3.80:1. This will supply additional acidity so that the reducing composition can effectively reduce the permanganate stains. When the permanganate stained article is acidic, the weight percent ratio should be in the range of about 1.80:1 to about 3.1:1. A ratio in this range will provide the additional alkalinity needed to prevent the article from lowering the pH to an unacceptable working pH where there would be a problem with sulfur dioxide odor. Thus, the overall range of the weight percent ratio of sulfur dioxide to ammonia to be employed with any type of article will be in the range of about 1.80:1 to about 3.80:1.

The reducing composition is prepared by adding sulfur dioxide and ammonia, preferably anhydrous ammonia, in the appropriate ratio to water until a pH in the range described above is achieved. The resulting solution will contain both ammonium bisulfite and ammonium sulfite. The amount of ammonium bisulfite and ammonium sulfite in the reducing composition can be adjusted by changing the pH or the ratio of sulfur dioxide to ammonia.

Generally, the percent by weight of sulfur dioxide in the reducing composition will be in the range of about 0.3 to about 48, preferably about 0.5 to about 5, and most preferably about 1.0 to about 1.5 percent based upon the total weight of water and sulfur dioxide in the reducing composition.

Since the ammonium sulfite/ammonium bisulfite reducing composition is effectively a buffering system, additional buffering is not essential. However, it is preferred to employ additional buffering in the form of an acid-buffer additive so that some of the factors influencing the reduction of the permanganate stains, such as time, temperature, and concentration of the sulfites in the reducing composition, will not be as critical. The employment of an acid-buffer additive helps maintain the pH of the reducing solution during the reduction step in the working range of about 3.5 to about 4.5, which is the most effective and efficient range for reducing the permanganate stains. As a result, the pH will remain more constant and remain in the preferred range of about 3.5 to about 4.5 for a longer period of time. Consequently, the time required for reducing the permanganate stains will be decreased. In other words, the employment of an acid-buffer additive improves control over the working pH thereby making the process more efficient.

A wide variety of acids and acid salts may be employed as the acid-buffer additive. Generally, any weak acid or acid salt that does not interfere with the ability of the reducing composition to reduce the permanganate stains may be employed. Preferred suitable acid-buffer additives include ammonium citrate, ammonium acetate, ammonium glycolate, acetic acid, citric acid and glycolic acid. One or more acids and/or acid salts may be employed in combination. As used herein, the term "acid-buffer additive" can refer to an acid, an acid salt, a combination of acids, a combination of acid salts, and a combination of an acid or acids and an acid salt or acid salts. If an acid salt is employed alone or in combination as the acid-buffer additive and the acid salt is a solid, it is preferred to dissolve the acid salt before adding it to the reducing composition. For example, the acid salt may be dissolved in water and then added to the reducing composition.

Although either an acid or an acid salt alone may be employed as the acid-buffer additive, it is preferred for the acid-buffer additive to be comprised of an acid and its ammonium salt. Most preferably, the acid-buffer additive will be comprised of about equal molar amounts of the acid and its ammonium salt.

The acid-buffer additive may be incorporated into the reducing solution prior to treating the article with the reducing composition. Preferably, however, the article is placed into the reducing composition and the acid-buffer additive is then added as a separate agent to the reducing composition. Generally, the acid-buffer additive is added to the reducing composition at a mole ratio in the range of about 1:0.1 to about 1:20, preferably about 1:0.5 to about 1:15, and most preferably about 1:1 to about 1:7 of the acid-buffer additive to the amount of the sulfur dioxide employed in preparing the reducing composition. For example, when acetic acid is employed as the acid-buffer additive, a suitable mole ratio of acetic acid to sulfur dioxide is about 1:1. However, it is preferred that when acetic acid is employed, the acid-buffer additive be comprised of approximately equal molar amounts of acetic acid and its ammonium salt, ammonium acetate. Thus, if the acid-buffer additive is comprised of acetic acid and its ammonium salt and a 1:1 mole ratio of the acid-buffer additive to the amount of sulfur dioxide employed in preparing the reducing composition is employed, about 0.5 mole of acetic acid and about 0.5 mole of ammonium acetate should be employed for each mole of sulfur dioxide. When glycolic acid is employed as the acid-buffer additive, a suitable mole ratio of glycolic acid to sulfur dioxide is about 1:3.6, and when citric acid is employed, a suitable mole ratio of citric acid to sulfur dioxide is about 1:7. Preferably, however, when these ratios for glycolic acid and citric acid are employed, the acid-buffer additive will be comprised of approximately equal molar amounts of the acid and its ammonium salt.

The permanganate stained article is exposed to the reducing composition for a period of time sufficient to remove the stains. Preferably, the article will be submerged and agitated in the reducing composition. The time of exposure will depend upon the degree of agitation, the amount of permanganate present on the article, the concentration of the sulfites in the reducing composition, and the temperature. Generally, if the article is exposed for about 8 to about 35 minutes, the stains will be removed. The permanganate stain may be reduced in one or more exposures to the reducing composition. For example, permanganate stained garments can be treated to two or more washing cycles in a normal washing machine which has added thereto the reducing composition.

After the permanganate has been reduced, the article is usually rinsed or washed with water one or more times to remove the residual reducing composition and then dried by any conventional means.

The invention is illustrated by the following example in which all percentages are by weight unless otherwise indicated.

EXAMPLE

Twenty-two pounds of jeans were placed in a washer and desized using an enzyme stripper. The jeans were then rinsed several times, dried, and then placed in a washer with potassium permanganate soaked pumice stones and tumbled for about fifteen minutes. Next, the jeans were separated from the stones and placed in a conventional washer where they were rinsed with water several times to get rid of all the loose permanganate on the jeans.

Three pounds of a reducing solution having a pH of about 5.5 and a sulfur dioxide to ammonia weight percent ratio of 3.51:1 was then added to the washer. The jeans were washed for fifteen minutes followed by three, two-minute rinses and a 40 minute drying period. Upon inspection, the permanganate stains were removed and the jeans had a stone-washed appearance.

By this process, fabrics of high quality, stone-washed appearance can be created. No perceptible sulfur dioxide gas was present during the process. This process, therefore, discloses a low cost means of reducing permanganate stains while maintaining a low sulfur dioxide odor.

What is claimed:

1. A bleaching process comprising the steps of:
(a) treating a fiber, fabric, or garment with a permanganate bleaching agent; and
(b) reducing the permanganate with a reducing composition containing sulfur dioxide and ammonia in amounts so that substantially no sulfur dioxide odor is detectable during the reduction step.

2. The process of claim 1 wherein the reducing composition has a pH in the range of about 1.5 to about 8.5.

3. The process of claim 1 wherein the reducing composition has a pH in the range of about 4.5 to about 6.5.

4. The process of claim 1 wherein the fiber, fabric or garment is acidic and the reducing composition has a pH in the range of about 6.5 to about 8.5.

5. The process of claim 1 wherein the fiber, fabric or garment is alkaline and the reducing composition has a pH in the range of about 1.5 to about 4.5.

6. The process of claim 1 wherein the sulfur dioxide and ammonia are present at a weight percent ratio in the range of about 1.80:1 to about 3.80:1.

7. The process of claim 6 wherein the sulfur dioxide and ammonia are present at a ratio in the range of about 3.1:1 to about 3.65:1.

8. The process of claim 6 wherein the fiber, fabric or garment is acidic and the sulfur dioxide and ammonia are present at a ratio in the range of about 1.80:1 to about 3.1:1.

9. The process of claim 6 wherein the fiber, fabric or garment is alkaline and the sulfur dioxide and ammonia are present at a ratio in the range of about 3.65:1 to about 3.80:1.

10. The process of claim 1 wherein the reduction of permanganate is carried out at a temperature in the range of about 60° F. to about 180° F.

11. The process of claim 1 wherein the reduction of permanganate is carried out at a temperature in the range of about 100° F. to about 150° F.

12. The process of claim 1 wherein the permanganate bleaching agent is selected from the group consisting of potassium permanganate and sodium permanganate.

13. The process of claim 1 wherein the permanganate bleaching agent is potassium permanganate.

14. The process of claim 1 wherein an acid-buffer additive is employed in conjunction with the reducing composition.

15. The process of claim 14 wherein the acid-buffer additive is selected from the group consisting of acetic acid, citric acid, glycolic acid, ammonium acetate, ammonium citrate and ammonium glycolate.

16. A bleaching process comprising the steps of:
(a) treating a fiber, fabric or garment with a permanganate bleaching agent; and
(b) reducing the permanganate with a reducing composition containing sulfur dioxide and ammonia at a weight percent ratio in the range of about 1.80:1 to about 3.80:1.

17. A bleaching process comprising the steps of:
(a) treating a fiber, fabric or garment with a permanganate bleaching agent; and
(b) reducing the permanganate with a reducing composition containing sulfur dioxide and ammonia at a weight percent ratio in the range of about 1.80:1 to about 3.80:1 and in the presence of an acid-buffer additive.

18. The process of claim 16 or 17 wherein the permanganate bleaching agent is selected from the group consisting of potassium permanganate and sodium permanganate.

19. The process of claim 16 wherein the permanganate bleaching agent is potassium permanganate.

20. The process of claim 17 wherein the permanganate bleaching agent is potassium permanganate.

21. The process of claim 16, 17 or 20 wherein the reducing composition has a pH in the range of about 1.5 to about 8.5.

22. The process of claim 16, 17 or 20 wherein the reducing composition has a pH in the range of about 4.5 to about 6.5.

23. The process of claim 17 or 20 wherein the reducing composition has a pH in the range of about 5.0 to about 6.0.

24. The process of claim 17 or 20 wherein the reducing composition has a pH in the range of about 5.5 to about 5.6.

25. The process of claim 16, 17 or 20 wherein the fiber, fabric or garment is acidic and the reducing composition has a pH in the range of about 6.5 to about 8.5.

26. The process of claim 16, 17 or 20 wherein the fiber, fabric or garment is alkaline and the reducing composition has a pH in the range of about 1.5 to about 4.5.

27. The process of claim 16, 17 or 20 wherein the fiber, fabric or garment is acidic and the sulfur dioxide and ammonia are present at a ratio in the range of about 1.80:1 to about 3.1:1.

28. The process of claim 16, 17 or 20 wherein the fiber, fabric or garment is alkaline and the sulfur dioxide and ammonia are present at a ratio in the range of about 3.65:1 to about 3.80:1.

29. The process of claim 17 wherein the sulfur dioxide and ammonia are present at a ratio in the range of about 3.1:1 to about 3.65:1.

30. The process of claim 17 wherein the sulfur dioxide and ammonia are present at a ratio in the range of about 3.3:1 to about 3.5:1.

31. The process of claim 16 wherein the sulfur dioxide and ammonia are present at a ratio of about 3.5:1.

32. The process of claim 16, 17 or 20 wherein the reduction of permanganate is carried out at a temperature in the range of about 60° F. to about 180° F.

33. The process of claim 16, 17 or 20 wherein the reduction of permanganate is carried out at a temperature in the range of about 100° F. to about 150° F.

34. The process of claim 17 or 20 wherein the acid-buffer additive is selected from the group consisting of acetic acid, citric acid, glycolic acid, ammonium acetate, ammonium citrate, and ammonium glycolate.

35. The process of claim 17 or 20 wherein the acid-buffer additive is employed at a mole ratio in the range of about 1:0.1 to about 1:20 of acid-buffer additive to the amount of sulfur dioxide employed in preparing the reducing composition.

36. The process of claim 35 wherein the acid-buffer additive is employed at a mole ratio in the range of about 1:0.5 to about 1:15.

37. The process of claim 36 wherein the acid-buffer additive is employed at a mole ratio in the range of about 1:1 to about 1:7.

38. The process of claim 35 wherein the acid-buffer additive is comprised of about equal molar amounts of an acid and its ammonium salt.

39. The process of claim 36 wherein the acid-buffer additive is comprised of about equal molar amounts of an acid and its ammonium salt.

40. The process of claim 37 wherein the acid-buffer additive is comprised of about equal molar amounts of an acid and its ammonium salt.

* * * * *